US007166046B1

(12) United States Patent
Liu

(10) Patent No.: US 7,166,046 B1
(45) Date of Patent: Jan. 23, 2007

(54) RETRACTABLE BASEBALL BAT

(75) Inventor: Chao-Jih Liu, Chung-Ho Tsun (TW)

(73) Assignee: Shyr Sheng Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 11/257,061

(22) Filed: Oct. 25, 2005

(51) Int. Cl.
*A63B 59/06* (2006.01)

(52) U.S. Cl. ..... 473/567; 473/457

(58) Field of Classification Search ..... 473/457, 473/519, 520, 564–568
See application file for complete search history.

(56) References Cited

U.S. PATENT DOCUMENTS 6,669,584 B1 * 12/2003 Miller ..... 473/568
6,875,137 B2 * 4/2005 Forsythe et al. ..... 473/566
2002/0072436 A1 * 6/2002 Liu ..... 473/457
2003/0013563 A1 * 1/2003 Ryan ..... 473/457
2004/0048696 A1 * 3/2004 Ciesar et al. ..... 473/457
2005/0153797 A1 * 7/2005 Nutter et al. ..... 473/457

* cited by examiner

*Primary Examiner*—Mark S. Graham
(74) *Attorney, Agent, or Firm*—Banner & Witcoff, Ltd.

(57) ABSTRACT

A baseball bat includes a tubular member having a slide rail, a tubular hitting portion sleeved on the tubular member, a handle inserted telescopically in the tubular member, and a locking unit having a first locking member provided on the handle and a second locking member disposed nonrotatably within the tubular member and slidable along the slide rail. The second locking member includes a main body having a tapering hole and an internal thread. The first locking member has an externally threaded tapering portion insertable into the tapering hole and engageable with the internal thread. The main body locks the handle against movement and permits the same to move relative to the tubular member when the externally threaded tapering portion is rotated threadedly in the tapering hole in an inward or outward direction.

11 Claims, 9 Drawing Sheets

RETRACTABLE BASEBALL BAT

BACKGROUND OF THE INVENTION

1. Field of the Invention

The invention relates to a baseball bat, more particularly to a retractable baseball bat.

2. Description of the Related Art

Baseball bats made of metal and wood are not safe to use by small children. Hence, a conventional baseball bat made of an ethylene vinyl acetate (EVA) foam material has been developed. However, since the length of such a conventional baseball bat is fixed, it cannot accommodate different physical sizes of users.

SUMMARY OF THE INVENTION

Therefore, the object of the present invention is to provide a baseball bat that is retractable to thereby accommodate different physical sizes of users.

According to this invention, a baseball bat comprises a tubular member including an inner wall, and a slide rail extending axially on the inner wall, a tubular hitting portion made of a foam material and sleeved on the tubular member, a handle inserted telescopically in the tubular member, and a locking unit. The locking unit includes a first locking member provided on the handle, and a second locking member disposed nonrotatably within the tubular member and slidable along the slide rail. The second locking member includes a main body having a substantially C-shaped cross section and an internal wall defining a tapering hole, and an internal thread formed on the internal wall. The first locking member has an externally threaded tapering portion insertable into the tapering hole and engageable with the internal thread. The main body is expandable to a locking position in which the main body abuts against the tubular member and locks the handle against movement relative to the tubular member when the externally threaded tapering portion is rotated threadedly in the tapering hole in an inward direction. The main body permits the handle to move relative to the tubular member when the externally threaded tapering portion is rotated threadedly in an outward direction.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
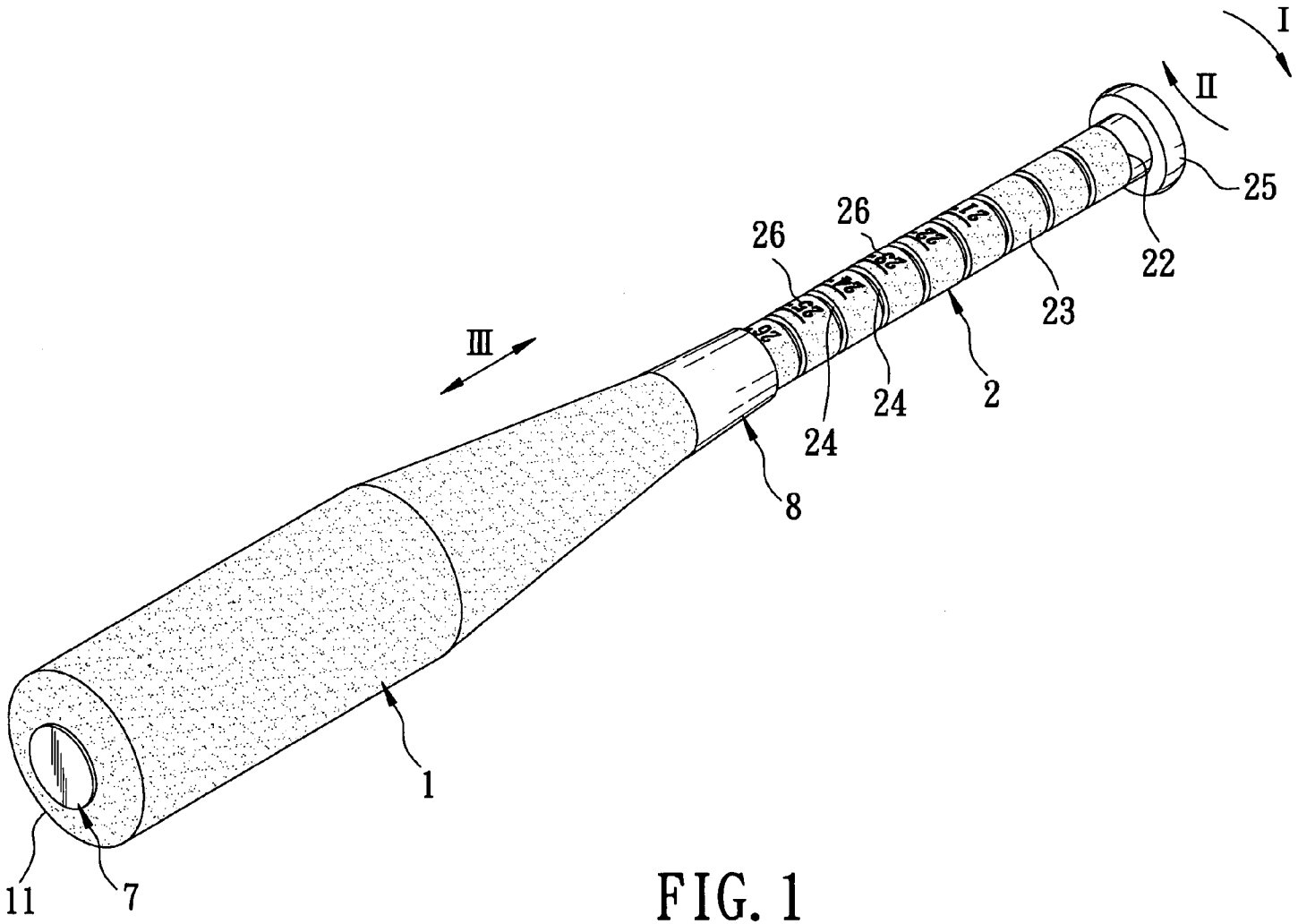
FIG. 1 is a perspective view of the preferred embodiment of a baseball bat according to the present invention.
Figure 2:
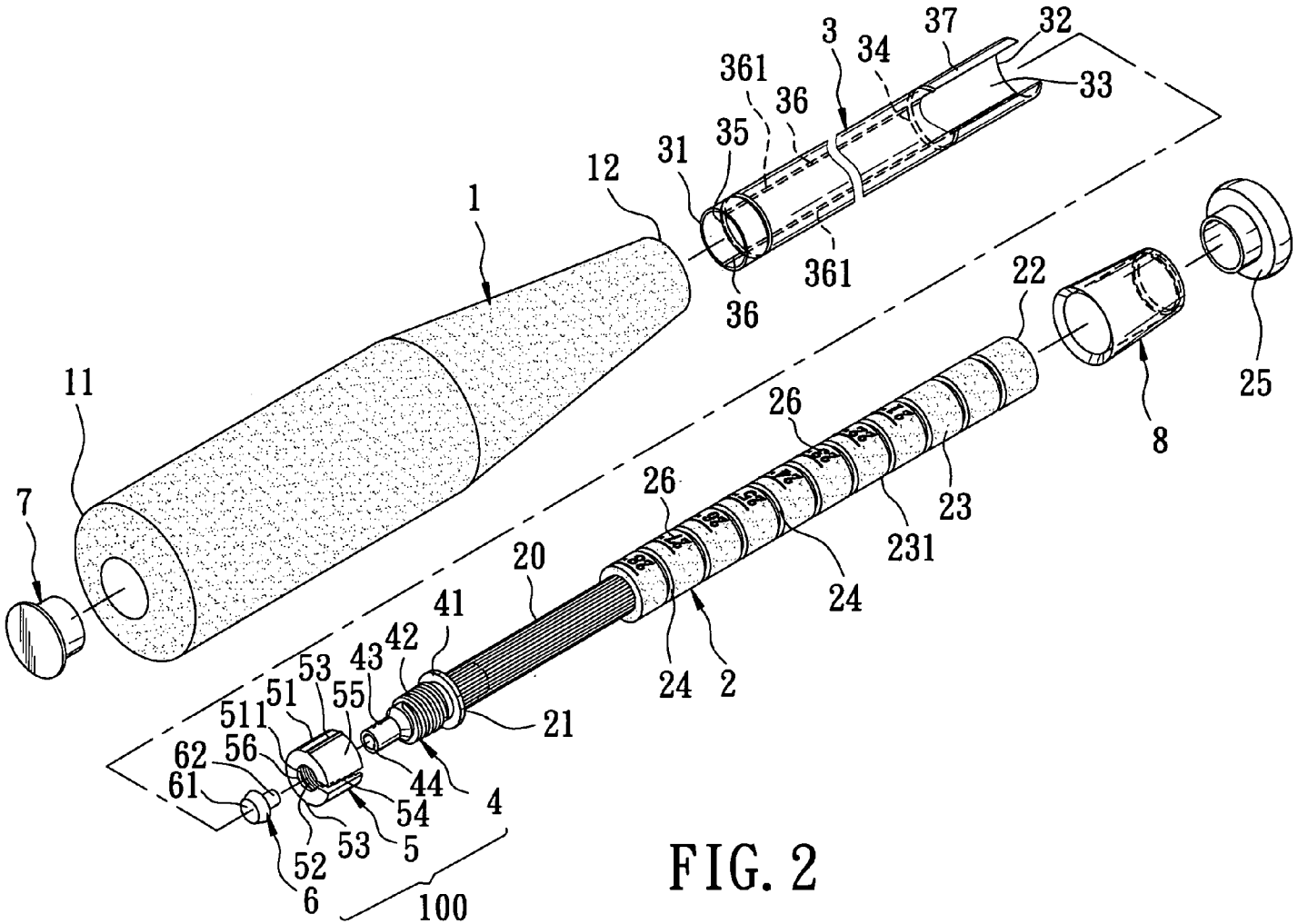
FIG. 2 is an exploded perspective view of the preferred embodiment.

Referring to FIGS. 1 to 4, the preferred embodiment of a baseball bat according to the present invention is shown to comprise a tubular hitting portion 1, a handle 2, a tubular member 3, a locking unit 100, a plug member 7, and a sleeve member 8.

The tubular hitting portion 1 is made of an ethylene vinyl acetate (EVA) foam material, and has a front end 11 and a rear end 12.

The tubular member 3 is inserted into the hitting portion 1, and has a front end 31, a rear end 32, a first limiting portion 34, a second limiting portion 35, and a pair of opposite slide rails 36. The front end 31 is flush with the front end 11 of the hitting portion 1. The rear end 32 extends outwardly from the rear end 12 of the hitting portion 1. The first limiting portion 34 is formed in an inner wall 33 of the tubular member 3 proximate to the rear end 32. The second limiting portion 35 is formed in the inner wall 33 proximate to the front end 31 to thereby be spaced apart from the first limiting portion 34. Each of the slide rails 36 is a slide groove 361 formed axially in the inner wall 33 of the tubular member 3.

The handle 2 is inserted telescopically in the tubular member 3, and includes a rod body 20 having a front end 21 and a rear end 22, a grip section 23 made of an ethylene vinyl acetate (EVA) foam material and sleeved on the rod body 20, a plurality of graduation marks 24 formed extending axially on an outer periphery 231 of the grip section 23, and a rear cover 25 fixed to the rear end 22 of the rod body 20. In this embodiment, the grip section 23 is provided with a plurality of spaced-apart annular grooves on the outer periphery 231 thereof to serve as the graduation marks 24. A plurality of numbers 26 are provided on the outer periphery 231 of the grip section 23 between each two adjacent ones of the graduation marks 24. The numbers 26 are labeled ⌈21"⌋, ⌈22"⌋, ⌈23"⌋, ⌈24"⌋, ⌈25"⌋, ⌈26"⌋, ⌈27"⌋, ⌈28"⌋, and represent 21~28 inches, respectively, that is, the total length of the baseball bat for different adjusting positions of the handle 2 as will be described below.

The locking unit 100 includes a first locking member 4, a second locking member 5, and a stop member 6. The first locking member 4 is formed integrally with the front end 21 of the handle 2, and is movable axially within the tubular member 3. The first locking member 4 has a flange portion 41, an externally threaded tapering portion 42 located in front of the flange portion 41, and a non-threaded tube portion 43 extending forwardly from the externally threaded tapering portion 42 and outwardly from the second locking member 5. The tube portion 43 has a reduced diameter compared to that of the externally threaded tapering portion 42.

The second locking member 5 is disposed nonrotatably within the tubular member 3, and includes a main body 51, an internal thread 52, and a pair of spaced-apart axial ridges 53. An axial split 54 is formed in the main body 51 to thereby result in a substantially C-shaped cross section for the main body 51. An internal wall 56 of the main body 51 defines a tapering hole 511. The internal thread 52 is formed on the internal wall 56 of the main body 51, and is engageable with the externally threaded tapering portion 42 when the externally threaded tapering portion 42 is inserted into the tapering hole 511. The axial ridges 53 are formed on an external wall 55 of the main body 51 to engage slidably and respectively the slide grooves 361 in the tubular member 3, thereby restricting the rotation of the handle 2 relative to the tubular member 3.

The stop member 6 has a head portion 61, and a shank portion 62 that projects outwardly from the head portion 61 and that is inserted fittingly into the tube portion 43 via a hole 44 in a front end of the tube portion 43 so as to prevent removal of the second locking member 5 from the first locking member 4.

Figure 9:
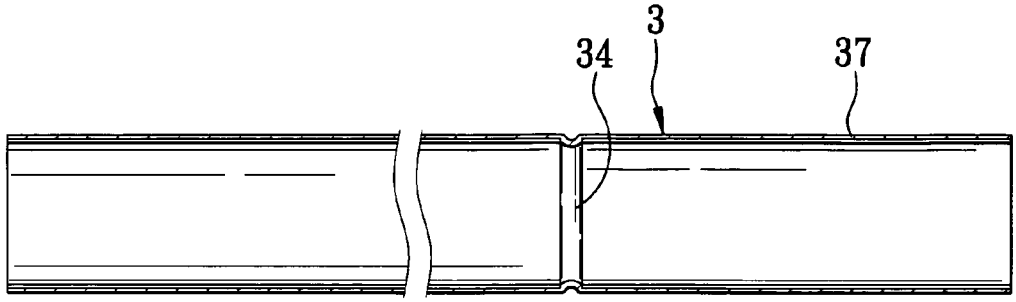
FIG. 9 is a fragmentary sectional view of a tubular member of the preferred embodiment.
Figure 10:
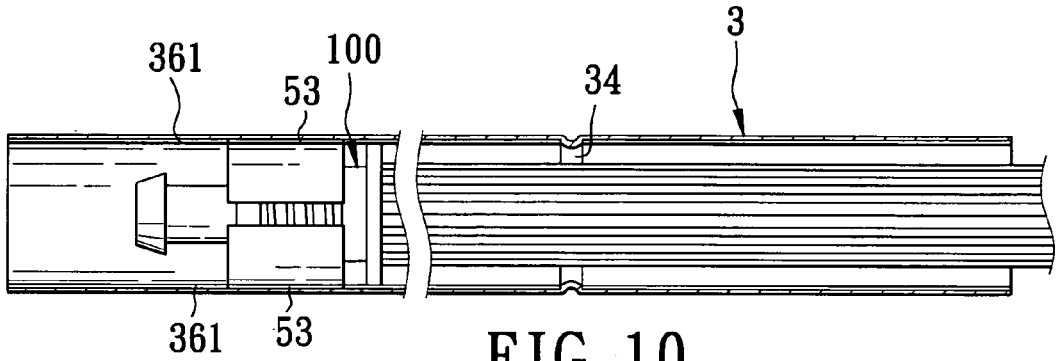
FIG. 10 is a fragmentary sectional view, illustrating a locking unit inserted into the tubular member after a first limiting portion is formed in the tubular member.
Figure 11:
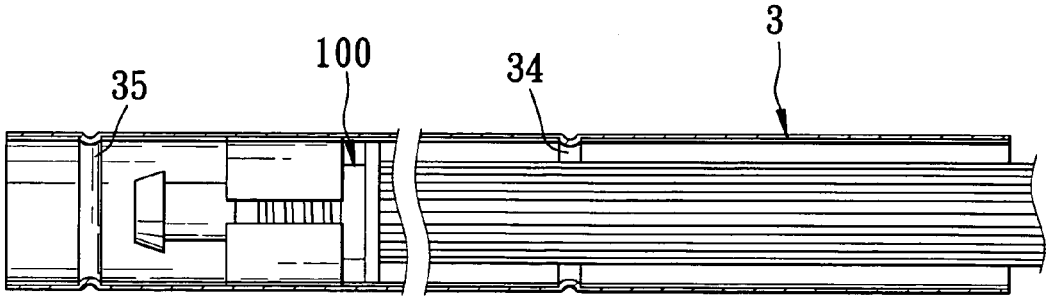
FIG. 11 is a fragmentary sectional view, illustrating that a second limiting portion is formed after the locking unit is inserted into the tubular member.

The tubular member 3 in this embodiment is made of metal, and has the first and second limiting portions 34, 35 each formed as an annular protrusion projecting inwardly from the inner wall 33 of the tubular member 3. The annular protrusions are formed by pressing and squeezing inwardly an outer wall 37 of the tubular member 3 through a roll forming process. Referring to FIGS. 9, 10, and 11, the tubular member 3 is first formed with the first limiting portion 34, and the locking unit 100 is then inserted and slid into the tubular member 3 with the axial ridges 53 engaging the slide grooves 361. When the locking unit 100 is moved to an intermediate section of the tubular member 3, the second limiting portion 35 is formed. Hence, movement of the locking unit 100 within the tubular member 3 is restricted between the first and second limiting portions 34, 35. Retraction and extension of the handle 2 relative to the tubular member 3 is therefore limited.

The plug member 7 is inserted into the front end 31 of the tubular member 3 for a decorative purpose.

The sleeve member 8 is sleeved on the rear end 32 of the tubular member 3 rearwardly of the hitting portion 1, and has a front end 81 abutting against the rear end 12 of the hitting portion 1, and a rear end 82 extending rearwardly from the rear end 12 of the hitting portion 1 to the rear end 32 of the tubular member 3. The sleeve member 8 also serves a decorative purpose.

Figure 3:
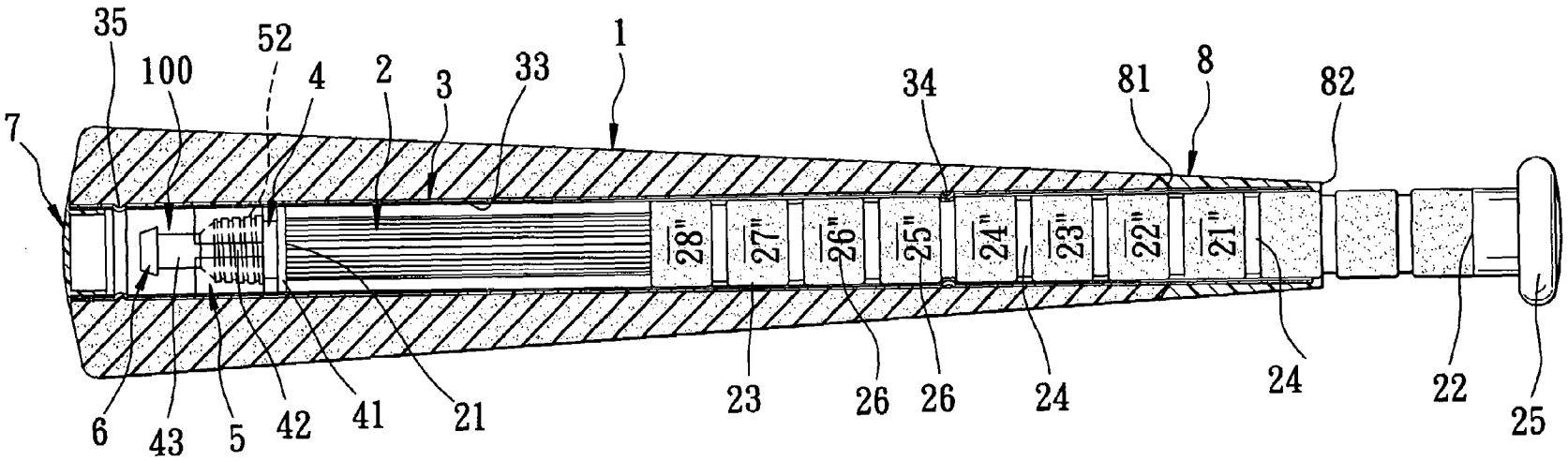
FIG. 3 is an assembled partly sectional view of the preferred embodiment, illustrating a handle in a retracted position.

When the handle 2 of the baseball bat of the present invention is in a retracted position shown in FIG. 3, the externally threaded tapering portion 42 of the first locking member 4 engages the internal thread 52 of the main body 51 of the second locking member 5 so as to expand the main body 51 to a locking position. At this time, the main body 51 abuts against the inner wall 33 of the tubular member 3, and locks the handle 2 against movement relative to the tubular member 3.

Figure 4:
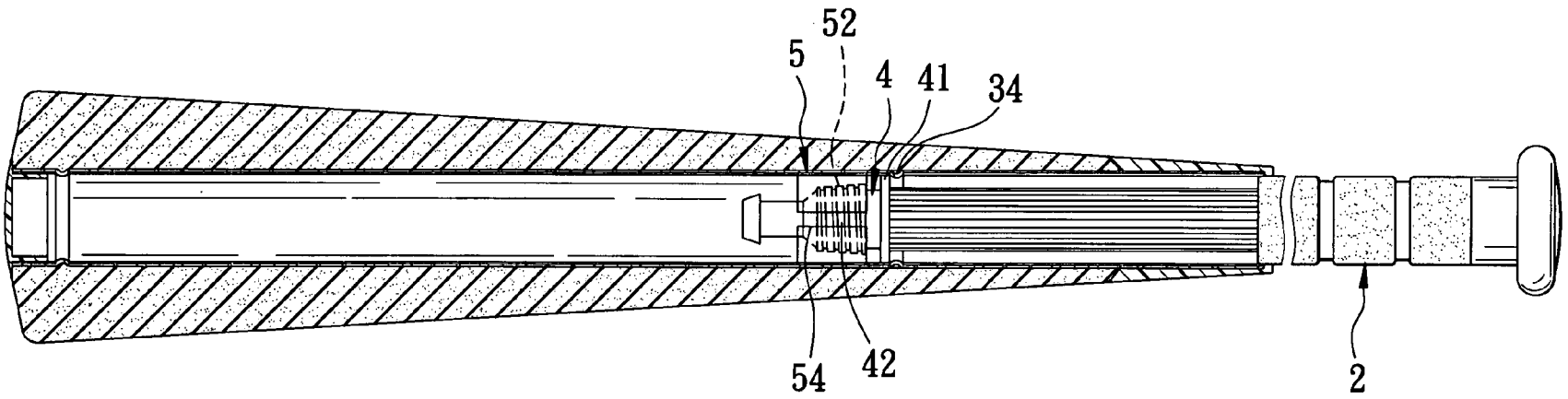
FIG. 4 is a view similar to FIG. 3, but illustrating the handle in an extended position.
Figure 5:
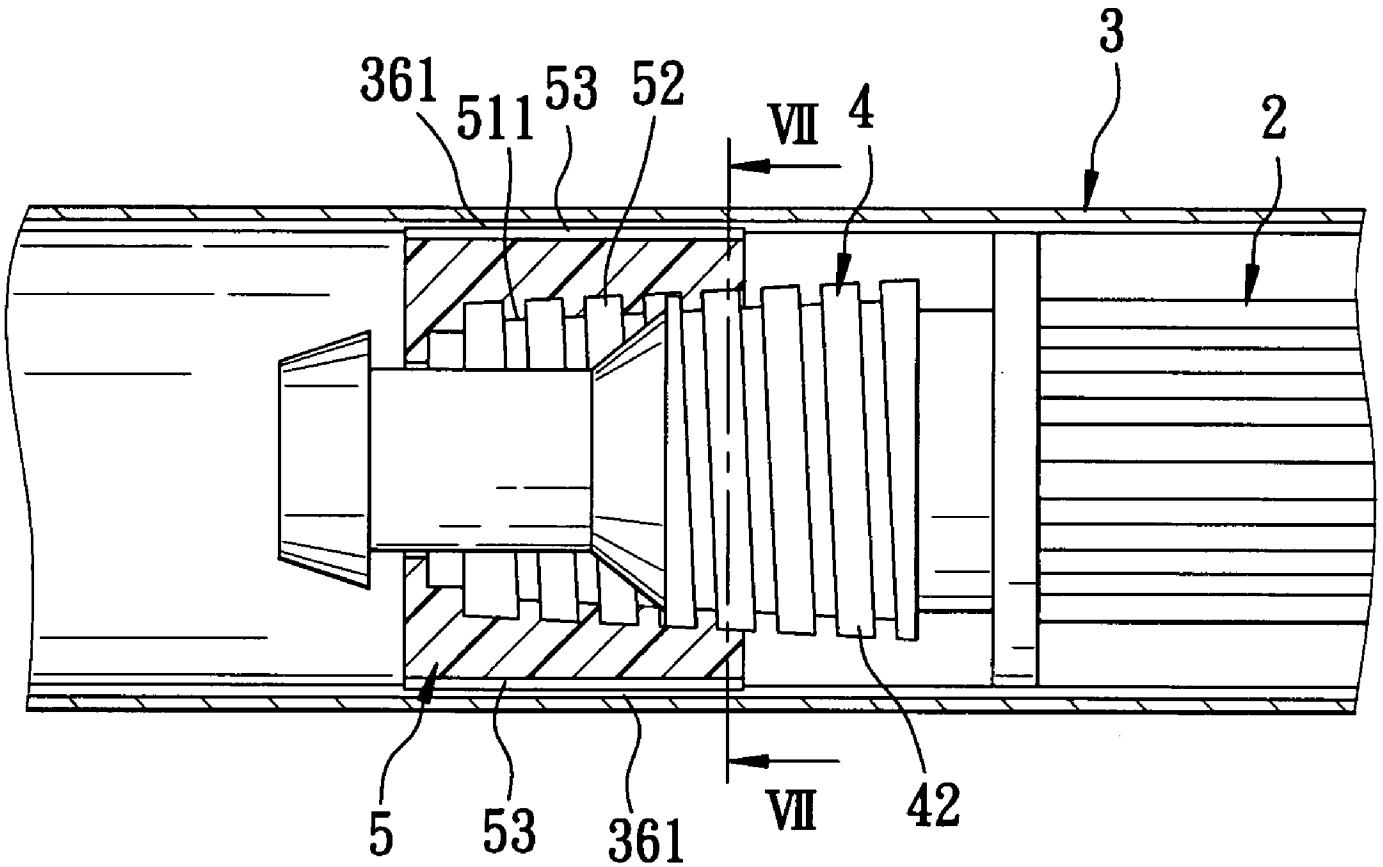
FIG. 5 is a fragmentary partly sectional view of the preferred embodiment, illustrating a first locking member being moved outward.
Figure 7:
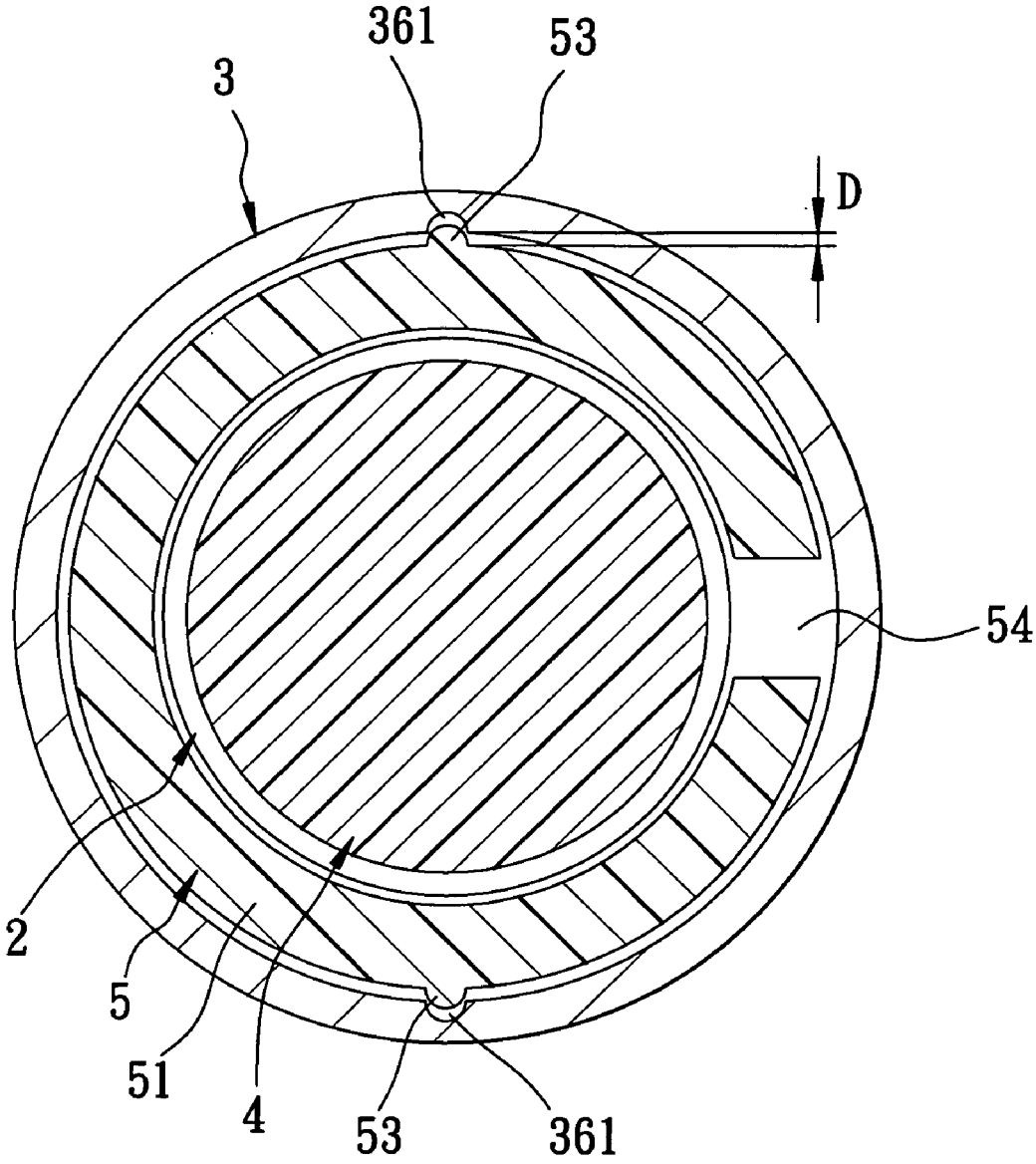
FIG. 7 is a sectional view of the preferred embodiment taken along line VII—VII of FIG. 5.

To adjust the handle 2 from the retracted position shown in FIG. 3 to an extended position shown in FIG. 4, the handle 2 is simply rotated in a counter clockwise direction (I) shown in FIG. 1, so that the externally threaded tapering portion 42 of the first locking member 4 gradually rotates away from the tapering hole 511 and disengages from the internal thread 52 of the main body 51 of the second locking member 5, as best shown in FIG. 5. Because a pressing force of the first locking member 4 is released from the main body 51 of the second locking member 5, a clearance (D) is formed between the first and second locking members 4, 5, as best shown in FIG. 7. The user can pull outwardly the handle 2 to a desired length at this time. In FIG. 4, the handle 2 is positioned at a maximum extended position whereat the flange portion 41 abuts against the first limiting portion 34.

Further, when the pressing force of the first locking member 4 is released from the main body 51 of the second locking member 5, the handle 2 can be moved toward or away from the tubular member 3, as shown by arrow (III) in FIG. 1, with the second locking member 5 moving axially within the tubular member 3 through engagement of the axial ridges 53 and the slide grooves 361.

Figure 6:
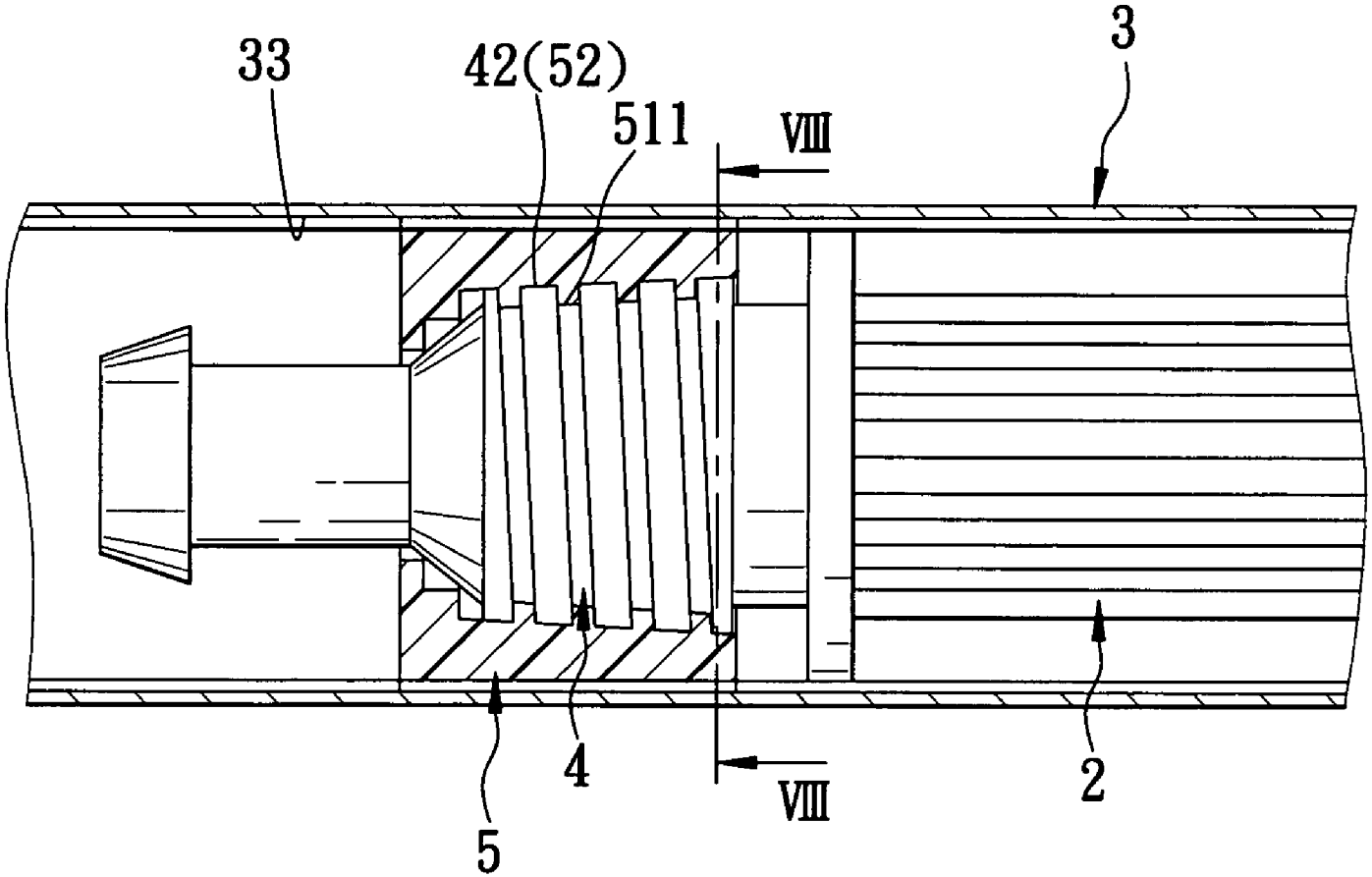
FIG. 6 is a view similar to FIG. 5, but illustrating the first locking member being moved inward.
Figure 8:
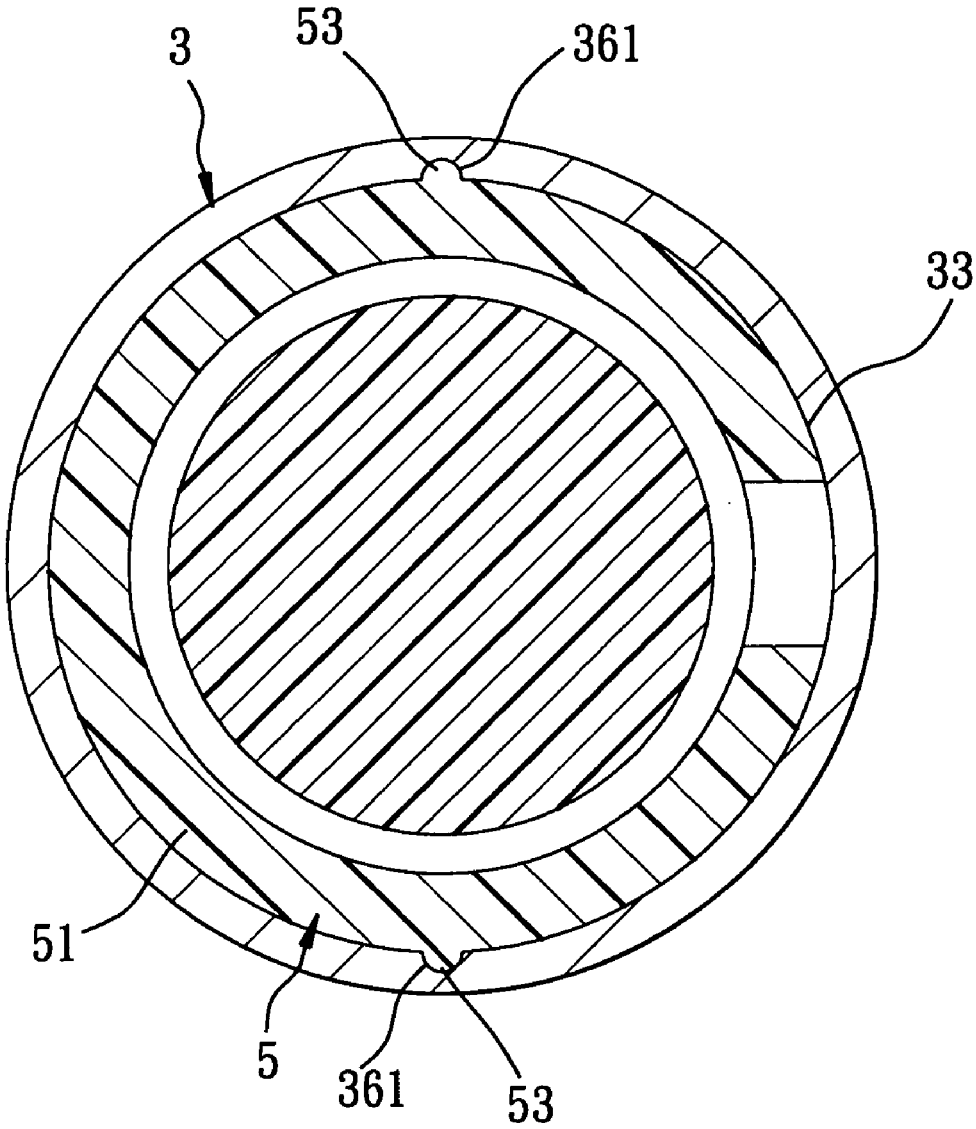
FIG. 8 is a sectional view of the preferred embodiment taken along line VIII—VIII of FIG. 6.

Referring to FIGS. 6 and 8, after the desired length of the handle 2 is achieved, the handle 2 is rotated in a clockwise direction (II) shown in FIG. 1, so that the externally threaded tapering portion 42 of the first locking member 4 rotates into the tapering hole 511 and engages threadedly the internal thread 52 of the second locking member 5. At this time, the main body 51 is forced to gradually expand, which is made possible through the presence of the split 54, thereby pressing against the inner wall 33 of the tubular member 3 so as to be disposed in the locking position. Hence, the handle 2 is locked against movement relative to the tubular member 3.

Therefore, when the length of the handle 2 does not suit a user, the user simply follows the abovementioned steps to make the desired adjustment.

The main purpose of the baseball bat of the present invention is to allow use of the baseball bat by young children. Since the length of the handle 2 can be adjusted, the baseball bat can accommodate different physical sizes of users.

Moreover, since the baseball bat of the present invention is retractable, the volume of the baseball bat may be reduced so that during transport, the required packing material is minimized, as are the transport costs.

Although the first and second limiting portions 34, 35 of the tubular member 3 in this embodiment are formed by a roll forming process so as to form the annular protrusions in the inner wall 33 of the tubular member 3, other configurations may be applicable, such as inserting a pin into a hole, providing a blocking ring, etc. Whichever structure is employed, as long as the inner wall 33 of the tubular member 3 is formed with a protrusion, a similar effect can be achieved.

As compared to the conventional baseball bat which has a fixed grip section and therefore a fixed overall length, the baseball bat of the present invention has the handle 2 that can be retracted or extended easily by operation of the locking unit 100.

With reference to FIGS. 1 and 3, the graduation marks 24 and the numbers 26 on the grip section 23 of the handle 2 facilitate user adjustment to the desired overall length by simply and quickly adjusting the handle 2 as described above.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A baseball bat comprising:

a tubular member including an inner wall, and a slide rail extending axially on said inner wall;

a tubular hitting portion made of a foam material and sleeved on said tubular member;

a handle inserted telescopically in said tubular member; and a locking unit including a first locking member provided on said handle, and a second locking member disposed nonrotatably within said tubular member and slidable along said slide rail;

wherein said second locking member includes a main body having a substantially C-shaped cross section and an internal wall defining a tapering hole, and an internal thread formed on said internal wall, said first locking member having an externally threaded tapering portion insertable into said tapering hole and engageable with said internal thread, said main body being expandable to a locking position in which said main body abuts against said tubular member and locks said handle against movement relative to said tubular member when said externally threaded tapering portion is rotated threadedly in said tapering hole in an inward direction, said main body permitting said handle to move relative to said tubular member when said externally threaded tapering portion is rotated threadedly in an outward direction.

2. The baseball bat of claim 1, wherein said slide rail is a slide groove formed axially in said inner wall of said tubular member, said main body further having an axial ridge formed on an outer surface of said main body to engage slidably said slide groove.

3. The baseball bat of claim 1, wherein said tubular member further includes front and rear ends, and a first limiting portion formed in said inner wall proximate to said rear end of said tubular member, said first locking member being formed on a front end of said handle and further having a flange portion engageable with said first limiting portion when said handle is moved rearwardly.

4. The baseball bat of claim 3, wherein said tubular member further has a second limiting portion formed in said inner wall proximate to said front end of said tubular member, said flange portion being engageable with said second limiting portion when said handle is moved forwardly.

5. The baseball bat of claim 4, wherein each of said first and second limiting portions is formed as an annular protrusion projecting inwardly from said inner wall of said tubular member.

6. The baseball bat of claim 5, wherein said annular protrusion is formed by pressing inwardly an outer wall of said tubular member through a roll forming process.

7. The baseball bat of claim 3, further comprising a sleeve member sleeved on said tubular member rearwardly of said hitting portion and extending rearwardly from a rear end of said hitting portion to said rear end of said tubular member.

8. The baseball bat of claim 7, further comprising a plug member inserted into said front end of said tubular member.

9. The baseball bat of claim 1, wherein said locking unit further includes a stop member having a head portion, and a shank portion projecting from said head portion, said first locking member further having a tube portion extending forwardly from said externally threaded tapering portion and outwardly from said main body, said shank portion being inserted fittingly into said tube portion.

10. The baseball bat of claim 1, wherein said handle has a rod body, a grip section made of a foam material and sleeved on said rod body, and a plurality of graduation marks formed on an outer periphery of said grip section.

11. The baseball bat of claim 10, wherein said grip section is provided with a plurality of spaced-apart annular grooves on said outer periphery of said grip section to serve as said graduation marks.

* * * * *